US009849956B2

(12) United States Patent
Tsutsui et al.

(10) Patent No.: US 9,849,956 B2
(45) Date of Patent: Dec. 26, 2017

(54) PUMP DEVICE AND SHIP PROPULSION MACHINE

(71) Applicant: Showa Corporation, Gyoda-shi (JP)

(72) Inventors: Hayato Tsutsui, Haga-gun (JP); Takahiko Saito, Haga-gun (JP); Atsushi Kagawa, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 152 days.

(21) Appl. No.: 14/862,650

(22) Filed: Sep. 23, 2015

(65) Prior Publication Data

US 2016/0257390 A1 Sep. 8, 2016

(30) Foreign Application Priority Data

Mar. 5, 2015 (JP) ..... 2015-043764

(51) Int. Cl.

| | |
|---|---|
| ***C23F 13/06*** | (2006.01) |
| ***B63H 20/10*** | (2006.01) |
| ***F02B 61/04*** | (2006.01) |

(52) U.S. Cl.

CPC ..... *B63H 20/10* (2013.01); *C23F 13/06* (2013.01); *F02B 61/045* (2013.01); *C23F 2213/31* (2013.01)

(58) Field of Classification Search

CPC ..... B63H 20/10; C23F 2213/31; F02B 61/045

See application file for complete search history.

(56) References Cited

U.S. PATENT DOCUMENTS 5,358,436 A * 10/1994 Soda et al. ..... 440/61
2012/0073961 A1 3/2012 Kagawa

FOREIGN PATENT DOCUMENTS

JP 04-005190 A 1/1992
JP 2012-071683 A 4/2012

* cited by examiner

*Primary Examiner* — Edwin Swinehart
(74) *Attorney, Agent, or Firm* — Leason Ellis LLP

(57) ABSTRACT

A pump device includes a first case, a second case, a sacrificial anode. The first case has a channel in which hydraulic fluid flows. The second case provides in contact with the first case. The sacrificial anode is coupled to one of the first case and the second case and suppresses corrosion of the first case and the second case. At least one of the first case and the second case includes an insulating section that interrupts electric coupling between the first case and the second case. The pump device further includes a valve member provided in the channel, controlling the flow of the hydraulic fluid flowing in the channel, and electrically coupling the first case and the second case.

6 Claims, 7 Drawing Sheets

PUMP DEVICE AND SHIP PROPULSION MACHINE

CROSS-REFERENCE TO RELATED APPLICATIONS

This application is based on and claims priority under 35 USC 119 from Japanese Patent Application No. 2015-043764 filed on Mar. 5, 2015, the entire content of which is incorporated herein by reference.

BACKGROUND OF THE INVENTION

1. Field of the Invention

The present invention relates to a pump device and a ship propulsion machine.

2. Description of the Related Art

There has been proposed a device that causes a cylinder device coupled between a ship body and a ship propulsion machine main body to expand and contract to change an angle of the ship propulsion machine main body with respect to the ship body.

For example, Japanese Patent Application Laid-Open No. 2012-71683 describes an electric corrosion preventing structure of a ship propulsion machine in which a cylinder is integrally formed with a cylinder block, an electric coupling section is provided in a portion where a rod guide is fixed to the cylinder, an electric coupling section is provided in a portion where a piston is fixed to a rod on the inside of the cylinder, and, when the rod is extended most to project from the cylinder, the piston fixed to the rod collides with the rod guide in an electrically coupled state.

Japanese Patent Application Laid-Open No. H4-5190 describes a corrosion preventing mechanism of an outboard motor in which a swivel case is axially supported on a stern bracket fixed to a ship body to be capable of swinging up and down, an outboard motor main body is rotatably supported on the swivel case, and a tilt cylinder device is interposed between the stern bracket and the swivel case. A first galvanic anode is attached to a lower part of the outboard motor main body, a second galvanic anode is attached to a submerging portion of the stern bracket, and the first and second galvanic anodes are coupled by a first electric coupling circuit. A second electric coupling circuit is divided from the first electric coupling circuit. The second electric coupling circuit is coupled to the tilt cylinder device.

Japanese Patent Application Laid-Open No. 2012-71683

Japanese Patent Application Laid-Open No. H4-5190

For example, when a ship propulsion machine is used in the sea, electro-corrosion easily occurs in which metal used in the ship propulsion machine is ionized by the seawater and dissolves.

Therefore, in some case, a sacrificial anode made of more easily ionized metal is attached, the sacrificial anode and portions of the ship propulsion machine are electrically coupled, and the sacrificial anode is preferentially electro-corroded to suppress the electro-corrosion from occurring in the other portions.

However, among members configuring the ship propulsion machine, it is difficult to electrically couple a member including an insulating section, which interrupts electric coupling, in a portion pressed against the other members to the sacrificial anode. Electro-corrosion easily occurs in a rod member.

SUMMARY OF THE INVENTION

It is an object of the present invention to provide a pump device and the like in which electric coupling to a sacrificial anode is secured by a simple configuration and electro-corrosion less easily occurs.

In order to attain the object, the present invention provides a pump device including: a first case having a channel in which hydraulic fluid flows; a second case provided in contact with the first case; and a sacrificial anode coupled to one of the first case and the second case and suppressing corrosion of the first case and the second case. At least one of the first case and the second case includes an insulating section that interrupts electric coupling between the first case and the second case. The pump device includes a valve member which is provided in the channel, controls the flow of the hydraulic fluid flowing in the channel and electrically couples the first case and the second case.

The valve member may include a valve main body pressed against one of the first case and the second case, and a pressing member that presses the valve main body.

The valve main body may be pressed against a portion of one of the first case and the second case wherein the insulating section is not formed at the portion. The pressing member may press the valve main body while being supported by a portion of other of the first case and the second case wherein the insulating section is not formed at the portion.

From another viewpoint, the present invention provides a pump device including: a first case having a first channel in which hydraulic fluid flows; a second case provided in contact with the first case and having a second channel that is connected to the first channel; and a sacrificial anode coupled to one of the first case and the second case and suppressing corrosion of the first case and the second case. At least one of the first case and the second case includes, in a portion in contact with the other one, an insulating section that interrupts electric coupling to the other one. The pump device includes a conductive member provided at an inside of at least one of the first channel and the second channel and electrically coupling the first case and the second case.

In the first channel, an electrically connectable first conductive section may be formed. An electrically connectable second conductive section is formed in the second channel. The conductive member may be a valve member including a valve main body and a pressing member that presses the valve main body. One of the valve main body and the pressing member may be in contact with the first conductive member and other of the valve main body and the pressing member may be in contact with the second conductive section.

Further, from still another viewpoint, the present invention provides a ship propulsion machine including: a ship propulsion machine main body including a propeller; and a tilt-trim device including a cylinder, a cylinder device including a piston that divides the inside of the cylinder into a first chamber and a second chamber and a piston rod, an end portion of which is fixed to the piston and which extends from the cylinder, and a pump device supplying hydraulic fluid to the inside of the cylinder device to thereby cause the cylinder device to expand and contract. The pump device includes: a first case having a channel in which hydraulic fluid flows; a second case provided in contact with the first case; and a sacrificial anode coupled to one of the first case and the second case and suppressing corrosion of the first case and the second case. At least one of the first case and the second case includes an insulating section that interrupts electric coupling between the first case and the second case. The pump device includes a valve member which is provided in the channel, controls the flow of the hydraulic fluid flowing in the channel and electrically couples the first case and the second case.

According to the present invention, it is possible to provide a pump device and the like in which electric coupling to a sacrificial anode is secured by a simple configuration and electro-corrosion less easily occurs.

EXPLANATION OF REFERENCE NUMERALS

Figure 1:
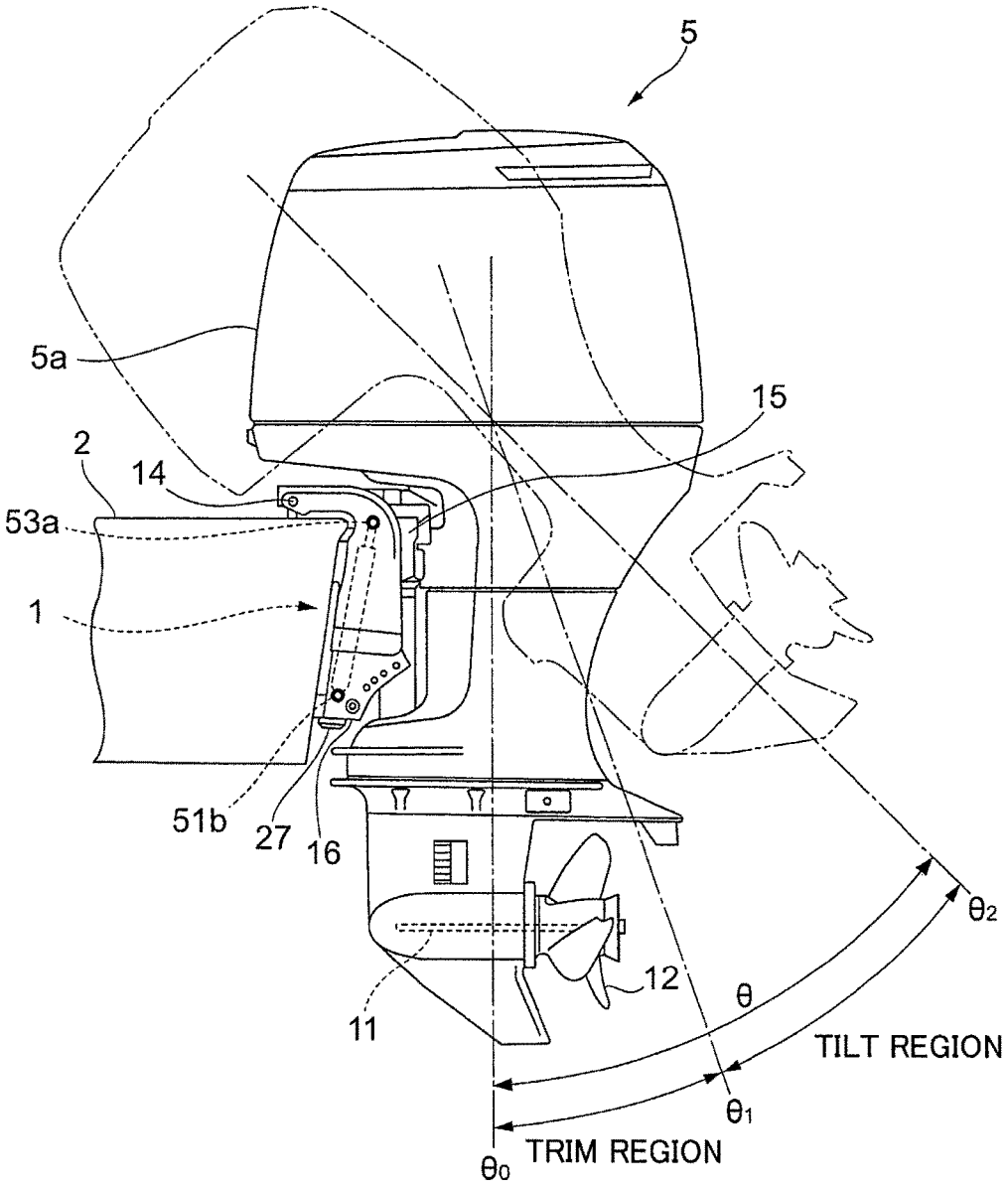
FIG. 1 is a schematic configuration diagram of an outboard motor applied with a tilt-trim device according to an embodiment of the present invention.

1 Tilt-trim device
5 Outboard motor
5*a* Outboard motor main body
51 Cylinder
51*k* Exposed section
181 Housing
181*c* Exposed section
300 Relief valve
301 Check ball
303 Coil spring

DESCRIPTION OF THE PREFERRED EMBODIMENT

An embodiment of the present invention is explained in detail below with reference to the accompanying drawings.

FIG. 1 is a schematic configuration diagram of an outboard motor 5 applied to a tilt-trim device 1 according to the embodiment of the present invention.

The outboard motor 5 includes an outboard motor main body 5*a* that generates a propulsion force to a ship body 2 of a ship and a tilt-trim device 1 that adjusts an inclination angle θ of the outboard motor main body 5*a* with respect to the ship body 2.

Schematic Configuration of the Outboard Motor Main Body 5*a*

The outboard motor main body 5*a* includes an engine (not shown in the figure) placed such that the axial direction of a crankshaft (not shown in the figure) faces the vertical direction (in FIG. 1, the up-down direction) with respect to a water surface and a driveshaft (not shown in the figure) rotatably integrally coupled to the lower end of the crankshaft and extending vertically downward. Further, the outboard motor main body 5*a* includes a propeller shaft 11 coupled to the driveshaft via a bevel gear mechanism and a propeller 12 attached to the rear end of the propeller shaft 11.

The outboard motor main body 5*a* includes a swivel shaft (not shown in the figure) provided in the vertical direction (in FIG. 1, the up-down direction) with respect to the water surface, a horizontal shaft 14 provided in the horizontal direction with respect to the water surface, and a swivel case 15 in which the swivel shaft is rotatably housed. The swivel case 15 is coupled to a pin hole 53*a* of a piston rod 53 of a cylinder explained below of the tilt-trim device 1 by a pin (not shown in the figure).

The inclination angle θ adjusted by the tilt-trim device 1 includes a trim region and a tilt region.

In the trim region (θ0 to θ1), the inclination angle θ of the outboard motor main body 5*a* is adjusted according to the posture of the ship. Further, when the speed of the ship increases, the bow rises and the propeller 12 faces the downward direction. In this case, efficiency of the propulsion generated by the outboard motor main body 5*a* decreases. Therefore, the inclination angle θ of the outboard motor main body 5*a* is adjusted in the trim region to direct the propeller 12 in the horizontal direction with respect to the water surface and suppress the efficiency of the propulsion from decreasing.

In the tilt region (θ1 to θ2), the outboard motor main body 5*a* can be lifted above the water surface (e.g., a state indicated by an alternate long and two short dashes line in the figure, an inclination angle of which is θ2) by inclining the outboard motor main body 5*a*. Consequently, it is possible to suppress shellfish and the like from adhering to the outboard motor main body 5*a* during anchorage of the ship and prevent the outboard motor main body 5*a* from being easily damaged.

Schematic Configuration of the Tilt-Trim Device 1

Figure 2:
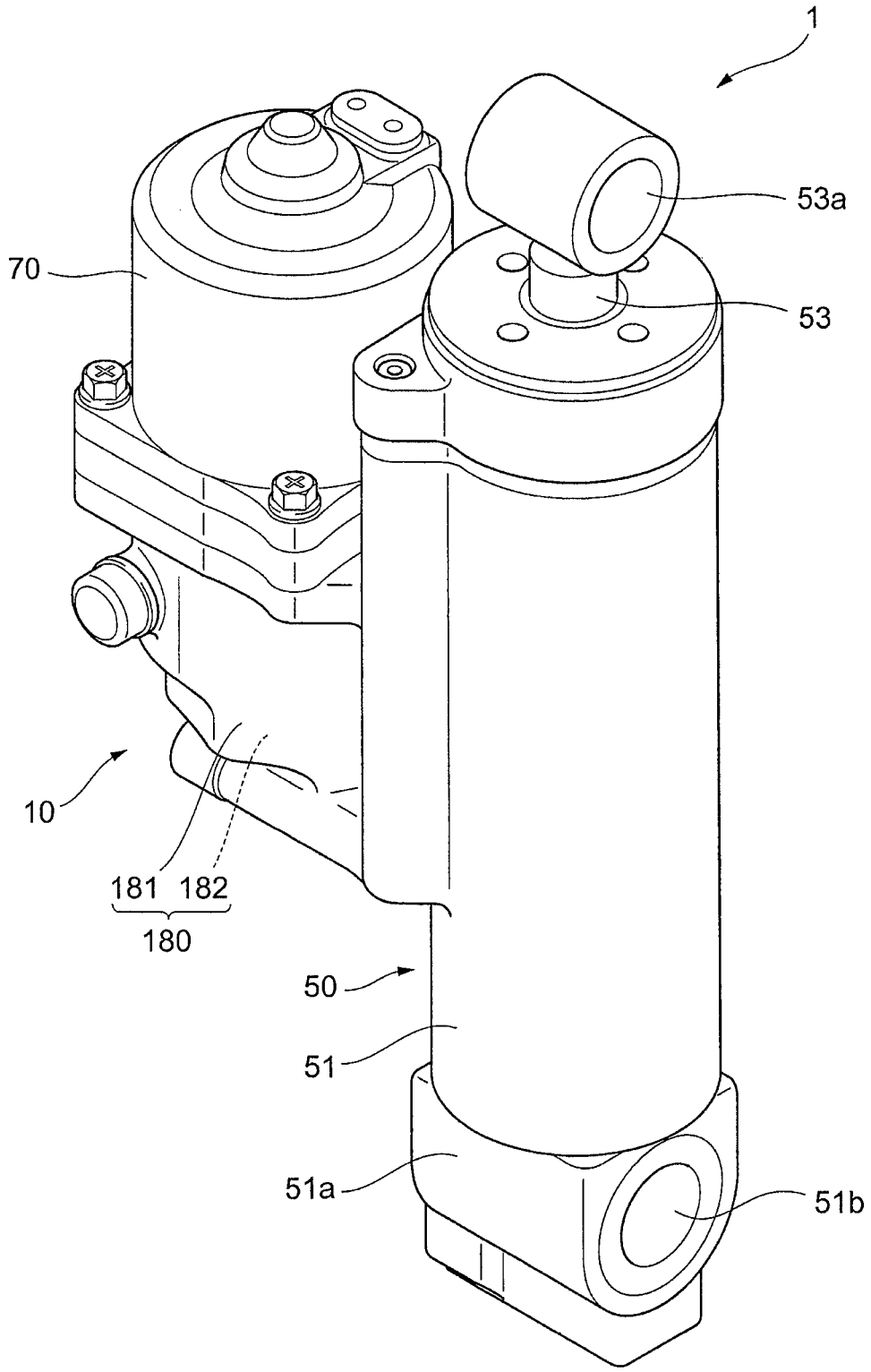
FIG. 2 is an external view of the tilt-trim device.

FIG. 2 is an external view of the tilt-trim device 1.

Figure 3:
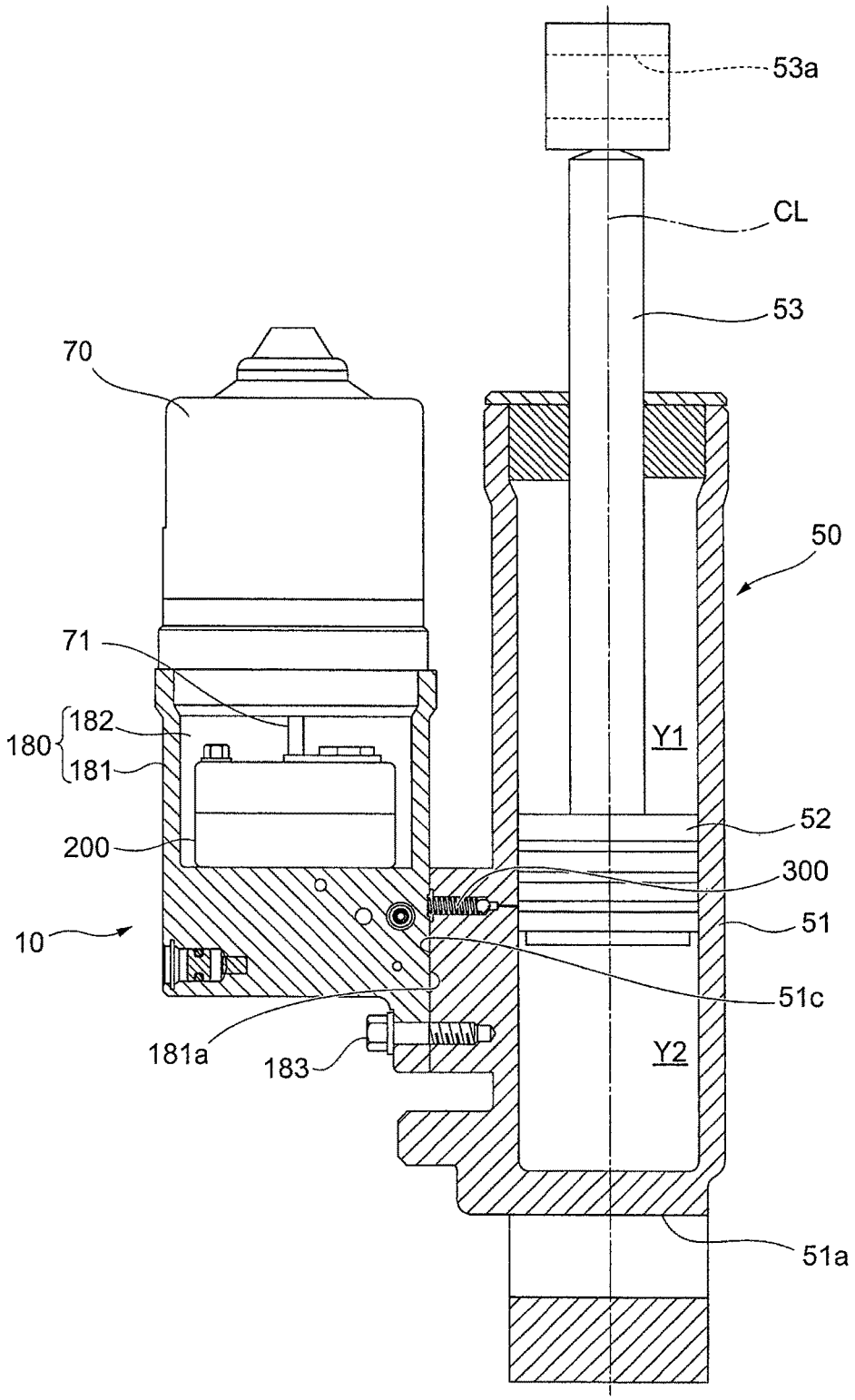
FIG. 3 is a partial sectional view of the tilt-trim device.

FIG. 3 is a partial sectional view of the tilt-trim device 1.

The tilt-trim device 1 includes, as shown in FIGS. 2 and 3, a cylinder device 50 that expands and contracts according to supply and discharge of oil, a pump device 10 that ejects the oil, and a motor 70 that drives the pump device 10.

The tilt-trim device 1 includes a stern bracket 16 (see FIG. 1) that connects the swivel case 15 of the outboard motor main body 5*a* to the ship body 2. The stern bracket 16 is coupled to a pin hole 51*b* of a cylinder 51 explained below by a pin (not shown in the figure).

The tilt-trim device 1 includes a sacrificial anode 27 (see FIG. 1), which is an example of a sacrificial anode of the present invention, made of metal in which electro-corrosion easily occurs. In this embodiment, the sacrificial anode 27 is provided in a lower part of the stern bracket 16 (see FIG. 1) and bolted to the stern bracket 16.

In the tilt-trim device 1, a large number of components made of metals such as iron, aluminum, and an aluminum alloy are used. Therefore, in particular, when the tilt-trim device 1 is used in the sea, an electric current flows via the seawater according to a potential difference generated among metals. As a result, electro-corrosion easily occurs in which the metals are ionized and dissolve into the seawater.

Therefore, in this embodiment, the sacrificial anode 27 made of metal more easily ionized than these metals is provided. The components made of the metals and the sacrificial anode 27 are electrically coupled to preferentially electro-corrode the sacrificial anode 27. Consequently, the electro-corrosion is suppressed from occurring in the other components.

Examples of the metal that can be used in the sacrificial anode 27 include zinc (Zn), a zinc alloy, magnesium (Mg), and a magnesium alloy.

Cylinder Device 50

The cylinder device 50 includes, as shown in FIG. 3, a cylinder 51 extending in an axis CL direction and a piston 52 disposed on the inside of the cylinder 51 and divides an internal space of the cylinder 51 into a first chamber Y1 and a second chamber Y2. The cylinder device 50 includes a piston rod 53 that holds the piston 52 at one end portion in the axis CL direction and moves in the axis CL direction with respect to the cylinder 51 together with the piston 52. Further, the cylinder device 50 includes a relief valve 300 (explained below) that allows oil in the first chamber Y1 to escape.

In the following explanation, when a direction in the axis CL direction of the cylinder 51 is indicated, downward in FIG. 3 is sometimes referred to as "downward" and upward in FIG. 3 is sometimes referred to as "upward".

The cylinder device 50 contracts when the oil is supplied to the first chamber Y1 and expands when the oil is supplied to the second chamber Y2. When the cylinder device 50 expands, the cylinder device 50 discharges the oil from the first chamber Y1. When the cylinder device 50 contracts, the cylinder device 50 discharges the oil from the second chamber Y2.

The cylinder device 50 includes a projecting section 51*a* in below the cylinder 51. In the projecting section 51*a*, a pin hole 51*b* into which a pin (not shown in the figure) for connection to the stern bracket 16 (see FIG. 1) of the outboard motor main body 5*a* is inserted is formed. At the upper end of the piston rod 53, a pin hole 53*a* into which a pin (not shown in the figure) for connection to the swivel case 15 (see FIG. 1) of the outboard motor main body 5*a* is inserted is formed.

In a state in which the cylinder device 50 is coupled to the stern bracket 16 via the pin hole 51*b* formed below the cylinder 51 and the cylinder device 50 is coupled to the swivel case 15 via the pin hole 53*a* formed in the piston rod 53, when the cylinder device 50 expands and contracts, the distance between the stern bracket 16 and the swivel case 15 changes. When the distance between the stern bracket 16 and the swivel case 15 changes, the inclination angle θ of the outboard motor main body 5*a* with respect to the ship body 2 changes.

Pump Device 10

The pump device 10 includes a tank 180 that stores oil and a pump 200 that is disposed in the tank 180 and ejects the oil stored in the tank 180.

Tank 180

The tank 180 includes, as shown in FIG. 3, a housing 181 and a tank chamber 182, which is a space surrounded by the housing 181 and the motor 70.

The housing 181 in an example shown in FIG. 3 is formed in a bottomed cylindrical shape opened upward. Holes (not shown in the figure) configuring a first channel 111 and a second channel 112 explained below are formed between the cylinder 51 and the housing 181.

As shown in FIG. 3, the motor 70 is fixed above the housing 181 to liquid-tightly close the upward opening. A drive shaft 71 of the motor 70 is coupled to the pump 200 disposed in the tank chamber 182. The motor 70 drives to rotate the drive shaft 71 to drive to rotate the pump 200.

The housing 181, which is an example of the first case of the present invention, is provided separately from the cylinder 51, which is an example of the second case of the present invention. In the example shown in the figure, the housing 181 is fixed to the cylinder 51 via a bolt 183. The housing 181 and the cylinder 51 press each other and are disposed to in direct contact with each other. A surface on the housing 181 side in a contact region of the housing 181 and the cylinder 51 is referred to as housing surface 181*a*. A surface on the cylinder 51 side is referred to as cylinder surface 51*c*.

The housing 181 and the cylinder 51 are respectively formed of, for example, aluminum. Surface treatment (alumite treatment) is applied to the respective outer circumferential surfaces of the housing 181 and the cylinder 51 in order to suppress electro-corrosion from occurring. In the example shown in the figure, as examples of the insulating section, the housing 181 includes a treated section 181*s* (see FIG. 5 referred to below), which is a portion applied with the outer circumferential surface treatment and the cylinder 51 includes a treated section 51*s* (see FIG. 5 referred to below), which is a portion applied with the outer circumferential surface treatment. Since such surface treatment is applied, in a region where the housing 181 and the cylinder 51 are in direct contact with each other, the housing 181 and the cylinder 51 are not electrically coupled.

Note that, in this embodiment, the surface treatment is also applied to the bolt 183 that fixes the housing 181 and the cylinder 51. That is, the housing 181 and the cylinder 51 are not electrically coupled via the bolt 183.

In this embodiment, a relief valve 300 (details are explained below) is provided in the region where the housing 181 and the cylinder 51 are in direct contact with each other. The relief valve 300 is located below the tank chamber 182 and above the bolt 183. Further, the bolt 183 shown in the figure is a member located at the bottom among members that bind the housing 181 and the cylinder 51.

Figure 4:
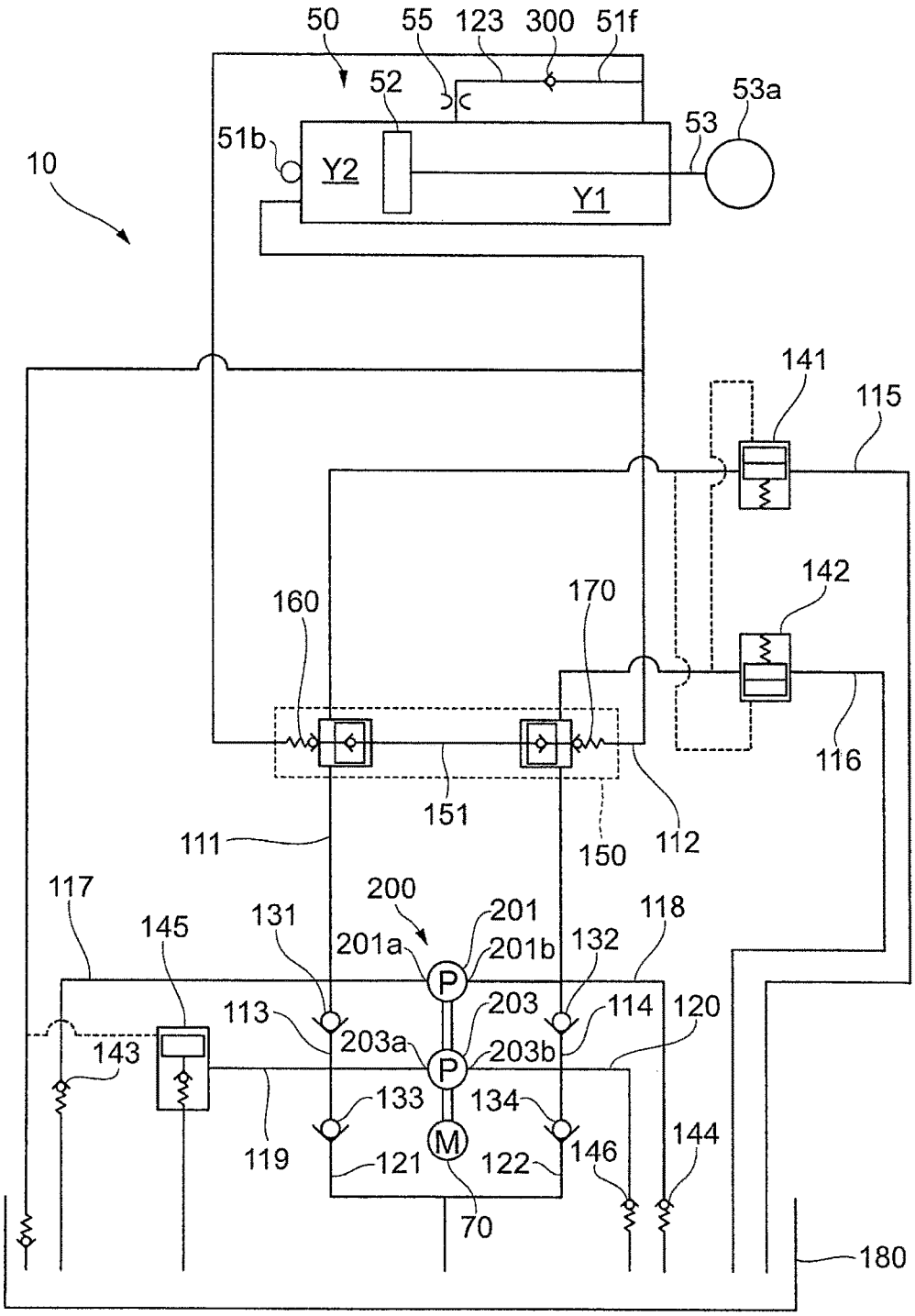
FIG. 4 is a hydraulic circuit of a pump device.

FIG. 4 shows a hydraulic circuit of the pump device 10.

Pump 200

The pump 200 includes, as shown in FIG. 4, a first pump 201 including a first ejecting section 201*a* and a second ejecting section 201*b* that respectively eject oil stored in the tank 180 and a second pump 203 including a third ejecting section 203*a* and a fourth ejecting section 203*b* that respectively eject the oil.

When the motor 70 normally rotates, the pump 200 ejects the oil from the first ejecting section 201*a* of the first pump 201 and the third ejecting section 203*a* of the second pump 203. On the other hand, when the motor 70 reversely rotates, the pump 200 ejects the oil from the second ejecting section 201*b* of the first pump 201 and the fourth ejecting section 203*b* of the second pump 203.

Disposition of Channels and Valves of the Pump Device 10

As shown in FIG. 4, the pump device 10 includes a first channel 111 that connects the first chamber Y1 of the cylinder device 50 and the first ejecting section 201*a* of the first pump 201 and a second channel 112 that connects the second chamber Y2 of the cylinder device 50 and the second ejecting section 201*b* of the first pump 201.

The pump device 10 includes a third channel 113 that connects the first chamber Y1 of the cylinder device 50 and the third ejecting section 203*a* of the second pump 203 and a fourth channel 114 that connects the second chamber Y2 of the cylinder device 50 and the fourth ejecting section 203*b* of the second pump 203.

In an example shown in the figure, the third channel 113 is connected to the first chamber Y1 of the cylinder device 50 via the first channel 111. The fourth channel 114 is connected to the second chamber Y2 of the cylinder device 50 via the second channel 112.

The pump device 10 includes a first check valve 131 that is provided in the third channel 113 and allows a flow of the oil from the third ejecting section 203*a* of the second pump 203 to the first channel 111 and prevents a flow from the first channel 111 to the third ejecting section 203*a*.

The pump device 10 includes a second check valve 132 that is provided in the fourth channel 114 and allows a flow of the oil from the fourth ejecting section 203*b* of the second pump 203 to the second channel 112 and prevents a flow from the second channel 112 to the fourth ejecting section 203*b*.

The pump device 10 includes a first suction path 121 that connects the third channel 113 and the tank 180 and circulates the oil stored in the tank 180 to the third ejecting section 203*a*.

The pump device 10 includes a second suction path 122 that connects the fourth channel 114 and the tank 180 and circulates the oil stored in the tank 180 to the fourth ejecting section 203*b*.

The pump device 10 includes a third check valve 133 that is provided in the first suction path 121 and allows a flow of the oil from the tank 180 to the third ejecting section 203*a* of the second pump 203 and prevents a flow from the third ejecting section 203*a* to the tank 180.

The pump device 10 includes a fourth check valve 134 that is provided in the second suction path 122 and allows a flow of the oil from the tank 180 to the fourth ejecting section 203*b* of the second pump 203 and prevents a flow from the fourth ejecting section 203*b* to the tank 180.

The pump device 10 includes a fifth channel 115 that branches from the first channel 111 and is connected to the tank 180 and a fifth channel switch valve 141 that is provided in the fifth channel 115 and receives the pressure of a sixth channel 116 explained below and opens the fifth channel 115.

The pump device 10 includes a sixth channel 116 that branches from the second channel 112 and is connected to the tank 180 and a sixth channel switch valve 142 that is provided in the sixth channel 116 and receives the pressure of the fifth channel 115 and opens the sixth channel 116.

The pump device 10 includes a seventh channel 117 that branches from the first channel 111 and is connected to the tank 180 and an eighth channel 118 that branches from the second channel 112 and is connected to the tank 180.

The pump device 10 includes a seventh channel switch valve 143 that is provided in the seventh channel 117 and opens when the pressure of the oil in the seventh channel 117 is higher than a seventh predetermined pressure set in advance and allows the oil in the first channel 111 to escape to the tank 180 via the seventh channel 117.

The pump device 10 includes an eighth channel switch valve 144 that is provided in the eighth channel 118 and opens when the pressure of the oil in the eighth channel 118 is higher than an eighth predetermined pressure set in advance and allows the oil in the second channel 112 to escape to the tank 180 via the eighth channel 118.

The pump device 10 includes a ninth channel 119 that branches from the third channel 113 and is connected to the tank 180 and a ninth channel switch valve 145 that is provided in the ninth channel 119 and receives the pressure of the second channel 112 and opens the ninth channel 119.

The pump device 10 includes a tenth channel 120 that branches from the fourth channel 114 and is connected to the tank 180 and a tenth channel switch valve 146 that is provided in the tenth channel 120 and opens when the pressure of the oil in the tenth channel 120 is higher than a tenth predetermined pressure set in advance and allows the oil in the tenth channel 120 to escape to the tank 180.

The pump device 10 includes a switching valve 150 that is connected to the first channel 111 and the second channel 112 and switches the direction of a flow of the oil ejected from the first pump 201.

The switching valve 150 includes a first switch valve 160 provided on the first channel 111 and a second switch valve 170 provided on the second channel 112.

A connection path 151 that allows the first switch valve 160 and the second switch valve 170 to be connected with each other is formed in the switching valve 150.

The pump device 10 includes a relief path 123 that connects the first chamber Y1 and the second chamber Y2 of the cylinder device 50.

The pump device 10 includes the relief valve 300 that is provided in the relief path 123 and opens when the pressure of the second chamber Y2 of the cylinder device 50 is higher than an eleventh predetermined pressure set in advance, allows the oil in the second chamber Y2 to escape, and prevents a flow of the oil from the first chamber Y1 to the second chamber Y2 and an orifice 55 that narrows a flow of the oil flowing from the second chamber Y2 to the relief valve 300.

Relief Valve 300

Figure 5:
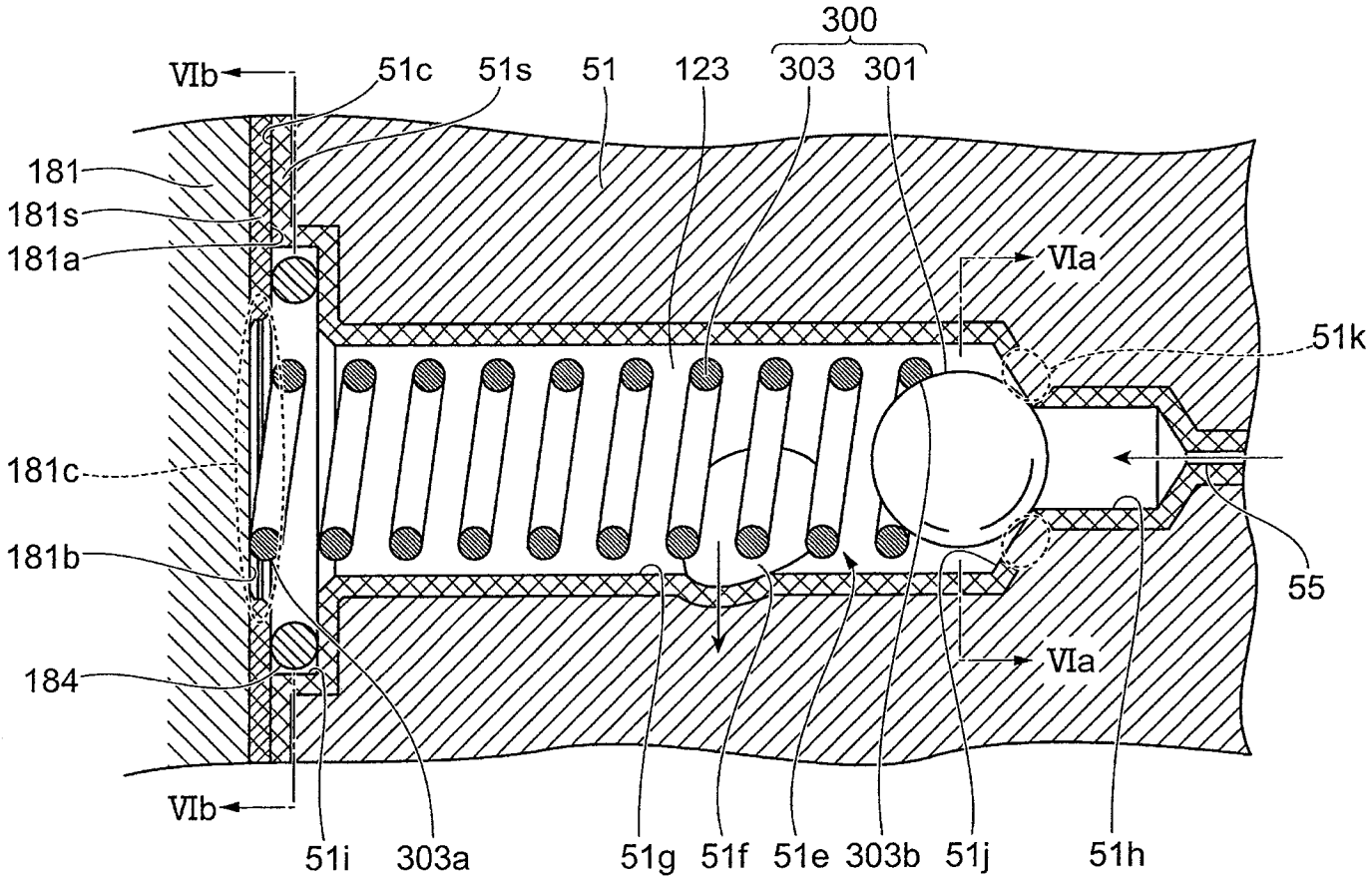
FIG. 5 is a diagram showing the structure of a relief valve.

FIG. 5 is a diagram showing the structure of the relief valve 300.

The structure of the relief valve 300 and the periphery of the relief valve 300 is explained with reference to FIG. 5.

The relief valve 300, which is an example of the valve member of the present invention, includes a check ball 301, which is an example of the valve main body of the present invention, and a coil spring 303, which is an example of the pressing member of the present invention. The check ball 301 and the coil spring 303 are formed of a so-called conductive material such as metal or resin including copper, iron, or an alloy of copper and iron. Therefore, the valve main body and the pressing member can be electrically coupled by coming into contact with each other.

The relief valve 300 is provided in the relief path 123 as explained above. The relief path 123, which is an example of the channel of the present invention, is explained. The relief path 123 includes a relief valve chamber 51*e* that is connected to the orifice 55 and houses the relief valve 300 and a connecting path 51*f* that connects the relief valve chamber 51*e* and the first chamber Y1 (see FIG. 3). The oil (hydraulic fluid) flowing from the orifice 55 into the relief valve chamber 51*e* flows to the first chamber Y1 via the connecting path 51*f*.

The relief valve chamber 51*e* is divided by a recess substantially circular in section opened in the cylinder surface 51*c*, which is the outer circumferential surface of the cylinder 51, a portion opened in the cylinder surface 51*c* is liquid-tightly closed by the housing surface 181*a* of the housing 181.

Further, the relief valve chamber 51*e* includes a main body section 51*g*, a small diameter section 51*h* provided on the opposite side (the orifice 55 side) of the cylinder surface 51*c* across the main body section 51*g*, and a large diameter section 51*i* provided at a position further toward the side of the cylinder surface 51*c* than the main body section 51*g* and opened in the cylinder surface 51*c*. Note that, on the respective surfaces of the main body section 51*g*, the small diameter section 51*h*, and the large diameter section 51*i*, like the cylinder surface 51*c*, the treated section 51*s* applied with the alumite treatment is formed.

The main body section 51*g* houses the relief valve 300 on the inside. The main body section 51*g* is contiguous to the connecting path 51*f* in the center in the axial direction of the main body section 51*g*. Further, the axis of the main body section 51*g* and the axis of the connecting path 51*f* extend in directions orthogonal to each other. The oil flowing into the main body section 51*g* from the orifice 55 changes the direction thereof and flows out to the connecting path 51*f*.

The main body section 51*g* includes, at an end portion on the small diameter section 51*h* in the axial direction, a taper section 51*j* inclined to be reduced in a diameter toward the small diameter section 51*h*. The check ball 301 of the relief valve 300 is pressed against the taper section 51*j*.

In the large diameter section 51*i*, a sealing member 184 that seals the oil in the relief valve chamber 51*e* is housed. The sealing member 184 in an example shown in the figure is a substantially annular elastic member (so-called O-ring). The inner diameter of the sealing member 184 is larger than the outer diameter of the coil spring 303. The sealing member 184 is provided to be pressed against the housing surface 181*a* of the housing 181.

The configuration of the housing 181 that closes the relief valve chamber 51*e* is explained. As explained above, the housing surface 181*a* of the housing 181 includes the treated section 181*s* applied with the alumite treatment. The housing 181 includes a recess 181*b* in a portion opposed to the relief valve chamber 51*e* on the housing surface 181*a*. The recess 181*b* is substantially circular in cross section and supports one end 303*a* of the coil spring 303. That is, the recess 181*b* functions as a seat of the coil spring 303.

In the relief valve 300 housed in the relief valve chamber 51*e*, the one end 303*a* of the coil spring 303 is supported by the recess 181*b* and the check ball 301 is supported by the taper section 51*j*. Consequently, the coil spring 303 is compressed. The elastic force of the compressed coil spring 303 urges the check ball 301 toward the taper section 51*j* side, whereby the pressure of the oil flowing into the relief valve chamber 51*e* from the orifice 55 is controlled.

Electric Coupling of the Cylinder 51 and the Housing 181

Figure 6A:
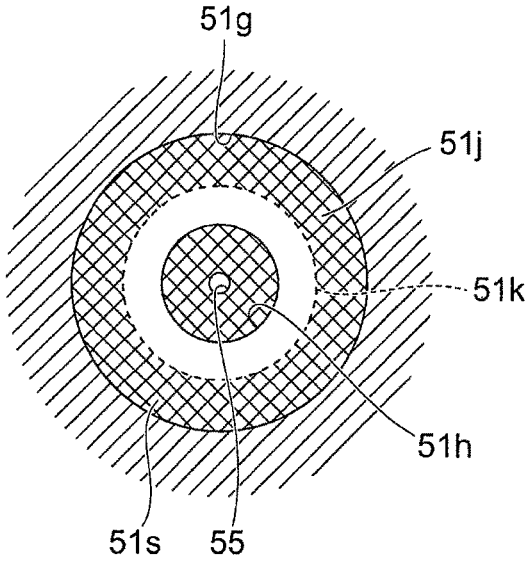
FIGS. 6A and 6B are diagrams for explaining an exposed section.
Figure 6B:
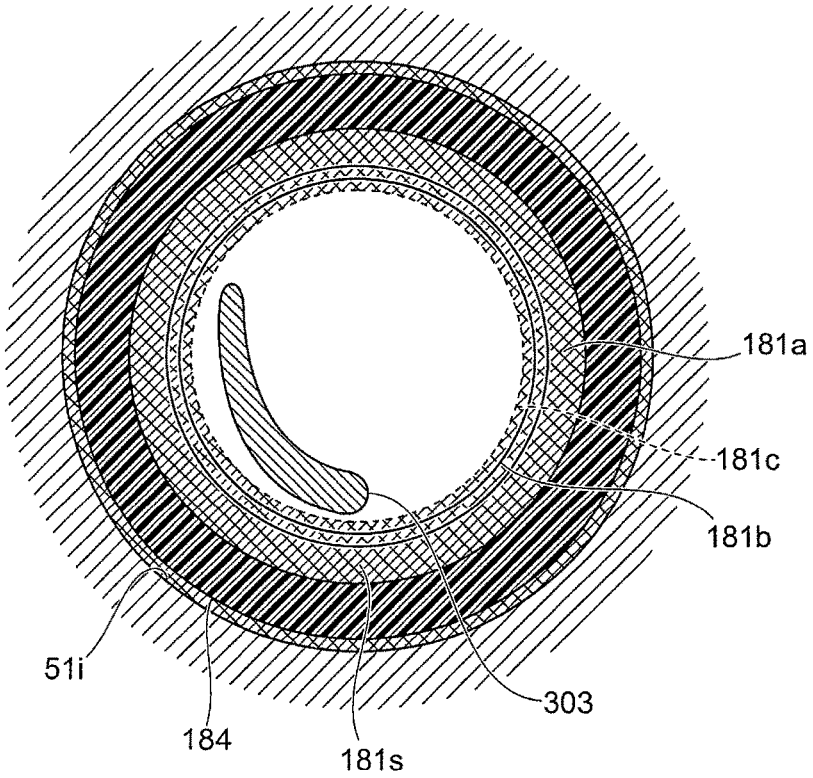

FIGS. 6A and 6B are diagrams for explaining exposed sections 51*k* and 181*c*. FIG. 6A is a cross section in VIa-VIa in FIG. 5 and is a diagram showing the exposed section 51*k*. Note that, in FIG. 6A, the check ball 301 is omitted. FIG. 6B is a cross section in VIb-VIb in FIG. 5 and is a diagram showing the exposed section 181*c*.

Electric coupling of the cylinder 51 and the housing 181 is explained with reference to FIG. 5 and FIGS. 6A and 6B.

As explained with reference to FIG. 1, the sacrificial anode 27 is electrically coupled to the portions of the outboard motor 5. In the pump device 10 shown in FIG. 3, the housing 181 is electrically coupled to the sacrificial anode 27. The cylinder 51 and the housing 181 are disposed in contact with each other. However, the alumite treatment is applied to the outer circumferential surface of the cylinder and the housing 181. Therefore, in a place where the cylinder 51 and the housing 181 are in direct contact with each other, the cylinder 51 and the housing 181 are not electrically coupled Therefore, in this embodiment, a portion that enables electric coupling is provided in a part of a surface forming the relief valve chamber 51*e*. The relief valve 300 formed of a conductive material is disposed in contact with the portion that enables electric coupling. Consequently, the cylinder 51 and the housing 181 are conducted (electrically coupled) via the relief valve 300.

In the following explanation, a specific configuration for electrically coupling the cylinder 51 and the housing 181 is explained.

As shown in FIGS. 5 and 6A, a portion (the exposed section) 51*k*, which is not applied with the alumite treatment and in which aluminum used as a material is exposed, is formed in a part of the taper section 51*j* of the cylinder 51. The exposed section 51*k*, which is an example of the second conductive section of the present invention, is located in a region against which the check ball 301 is pressed in the taper section 51*j*. Note that the exposed section 51*k* is an example of a portion where the insulating section is not formed.

As shown in FIGS. 5 and 6B, similarly, a portion (the exposed section) 181*c*, which is not applied with the alumite treatment and in which aluminum used as a material is exposed, is formed in the recess 181*b* of the housing 181. The exposed section 181*c*, which is an example of the first conductive section of the present invention, is located in a region against which the one end 303*a* of the coil spring 303 is pressed in the recess 181*b*.

The exposed section 51*k* and the exposed section 181*c* are parts of a surface that divides the relief valve chamber 51*e*. Oil is stored in the relief valve chamber 51*e*. By the presence of the oil, the exposed section 51*k* and the exposed section 181*c* are suppressed from being corroded.

Further, as shown in FIG. 5, the exposed section 51*k* and the exposed section 181*c* are formed in regions further on the inner diameter side than the sealing member 184. The outer circumferences of these portions are present in regions surrounded by the sealing member 184. The regions are positions where the seawater entering from the outside less easily reaches.

With the configuration explained above, in a state in which the relief valve 300 is disposed in the relief valve chamber 51*e*, the check ball 301 is pressed against the exposed section 51*k* of the cylinder 51 and the one end 303*a* of the coil spring 303 is pressed against the exposed section 181*c* of the housing 181. The other end 303*b* of the coil spring 303 and the check ball 301 are pressed against each other. Consequently, the cylinder 51 and the housing 181 are electrically coupled via the relief valve 300.

As explained above, the coil spring 303 is disposed in the relief valve chamber 51*e* in the compressed state. For example, even when the outboard motor 5 (see FIG. 1) receives vibration from the outside, with the elastic force of the coil spring 303, the check ball 301 is suppressed from being separated from the exposed section 51*k* or the one end 303*a* of the coil spring 303 is suppressed from being separated from the exposed section 181*c*. As a result, electric coupling in the cylinder 51 and the housing 181 is secured. In addition, in this embodiment, since the relief valve 300 is used, a dedicated component for securing electric coupling of the cylinder 51 and the housing 181 is unnecessary.

The exposed section 51*k* and the exposed section 181*c* are respectively formed by applying masking, for example, when the cylinder 51 and the housing 181 are subjected to the alumite treatment. That is, unlike other regions, regions applied with the masking are regions remaining without being applied with the alumite treatment, that is, the exposed section 51*k* and the exposed section 181*c*.

Note that, unlike this forming method, the exposed section 51*k* and the exposed section 181*c* may be formed by applying machining, for example, shaving parts of the surfaces of the cylinder 51 and the housing 181 after subjecting the entire outer circumferential surfaces of the cylinder 51 and the housing 181 to the alumite treatment.

Modifications

Figure 7A:
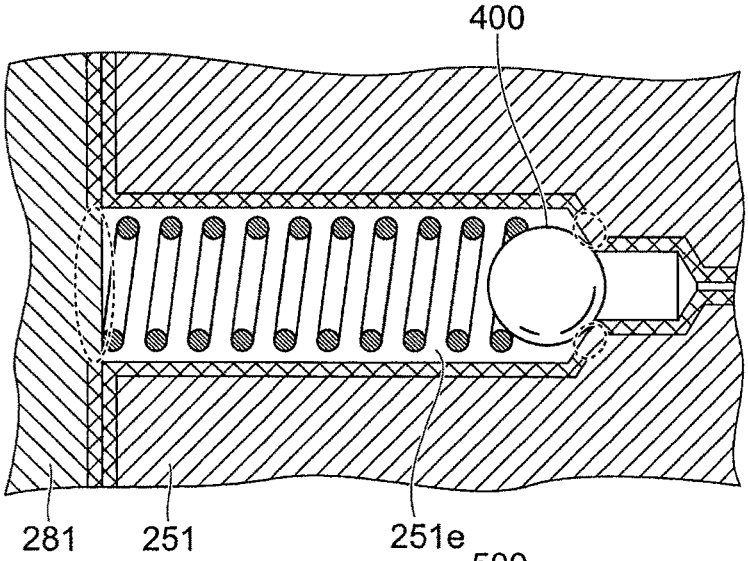
FIGS. 7A, 7B and 7C are diagrams for explaining modifications.
Figure 7B:
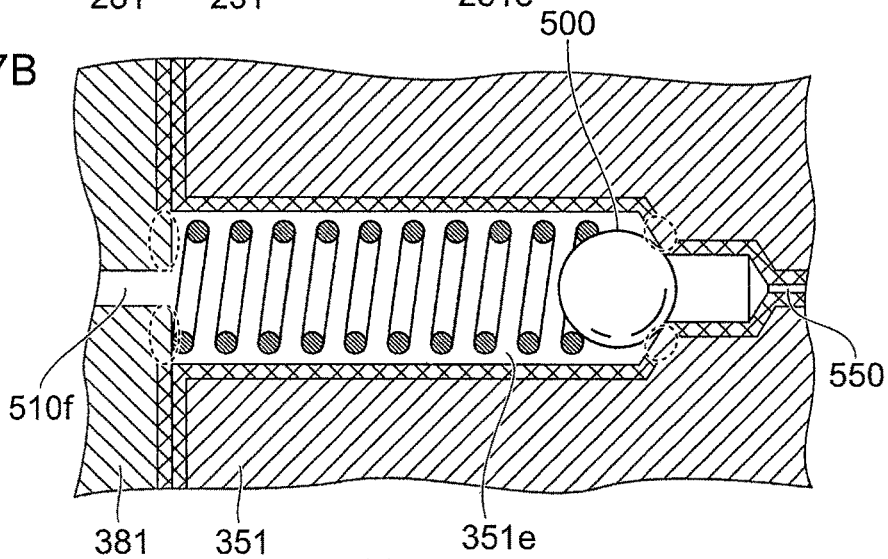
Figure 7C:
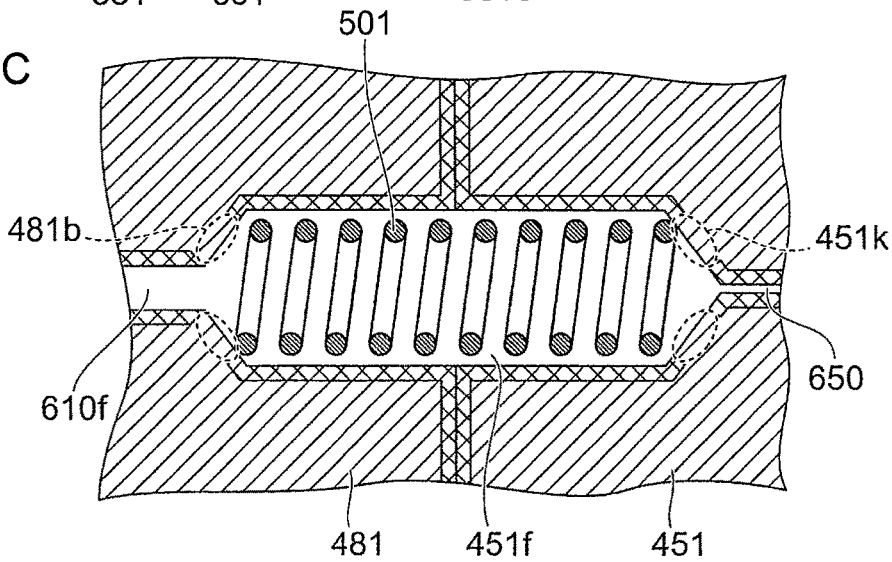

FIGS. 7A to 7C are diagrams for explaining modifications.

In the above explanation referring to FIG. 5, the housing 181 includes the recess 181*b* in the portion opposed to the relief valve chamber 51*e*. However, the present invention is not limited to this.

For example, as shown in FIG. 7A, a portion opposed to a relief valve chamber 251*e* in a housing 281 may be flat and may not include the recess 181*b* (see FIG. 5).

Further, a space (a recess) for housing a relief valve 400 may be provided in one of a cylinder 251 and the housing 281 or may be provided in both of the cylinder 251 and the housing 281.

In the above explanation referring to FIG. 5, the relief valve 300 is provided in the relief valve chamber 51*e*, that is, electric coupling is secured in a place where the oil flowing in from the orifice 55 changes the direction of the flow and flows out to the connecting path 51*f*. However, the present invention is not limited to this.

For example, as shown in FIG. 7B, a cylinder 351 and a housing 381 may be formed. That is, in a relief valve chamber 351*e* in which oil flowing in from an orifice 550 flows out to a connecting path 510*f* without changing the direction of the flow, a relief valve 500 may be provided.

In the explanation referring to FIG. 5, the electric coupling is secured by the relief valve 300. However, the configuration explained above may be adopted in other valves.

Alternatively, a member other than a valve may be adopted as long as electric coupling is secured. For example, as shown in FIG. 7C, a spring 501 in a compressed state may be disposed in a space in which oil flowing in from an orifice (a first channel) 650 flows out to a connecting path (a second channel) 610*f*, that is, a space 451*f* sandwiched by a cylinder 451 and a housing 481. In other words, the spring 501 may be in a stretched state in the space 451*f* and disposed in contact with an exposed section 451*k* of the cylinder (a first case) 451 and an exposed section 481*b* of the housing (a second case) 481.

In the explanation referring to FIG. 5, the cylinder 51 and the housing 181 are disposed in direct contact with each other. However, the present invention is not limited to this. Other members may be interposed between the cylinder 51 and the housing 181 as long as the cylinder 51 and the housing 181 are electrically coupled by the relief valve 300 or the like.

The various embodiments and modifications are explained above. However, naturally, the embodiments and the modifications may be combined with one another.

This disclosure is not limited by the embodiments at all and can be carried out in various forms without departing from the spirit of this disclosure.

What is claimed is:

1. A pump device comprising:

a first case having a channel in which hydraulic fluid flows;

a second case provided in contact with the first case; and a sacrificial anode coupled to one of the first case and the second case and suppressing corrosion of the first case and the second case, wherein at least one of the first case and the second case comprises an insulating section that interrupts electric coupling between the first case and the second case, and the pump device further comprising a valve member provided in the channel, controlling the flow of the hydraulic fluid flowing in the channel, and electrically coupling the first case and the second case.

2. The pump device according to claim 1, wherein the valve member comprises a valve main body pressed against one of the first case and the second case, and a pressing member that presses the valve main body.

3. The pump device according to claim 2, wherein the valve main body is pressed against a first portion of one of the first case and the second case wherein the insulating section is not formed at the first portion, and the pressing member presses the valve main body while being supported by a second portion of other of the first case and the second case wherein the insulating section is not formed at the second portion.

4. A pump device comprising:

a first case having a first channel in which hydraulic fluid flows;

a second case having a second channel that is connected to the first channel; and a sacrificial anode coupled to one of the first case and the second case and suppressing corrosion of the first case and the second case, wherein the first case is fixed to the second case, at least one of the first case and the second case comprises an insulating section that interrupts electric coupling to the other one in a region where the first case and the second case are in contact each other, the pump device further comprising a conductive member provided at an inside of at least one of the first channel and the second channel and electrically coupling the first case and the second case.

5. The pump device according to claim 4, wherein an electrically connectable first conductive section is formed in the first channel, an electrically connectable second conductive section is formed in the second channel, the conductive member is a valve member comprising a valve main body and a pressing member that presses the valve main body, one of the valve main body and the pressing member is into contact with the first conductive member, and other of the valve main body and the pressing member is into contact with the second conductive section.

6. A ship propulsion machine comprising:

a ship propulsion machine main body comprising a propeller; and a tilt-trim device comprising a cylinder, a cylinder device comprising a piston that divides an inside of the cylinder into a first chamber and a second chamber and a piston rod, an end portion of which is fixed to the piston and which extends from the cylinder, and a pump device supplying hydraulic fluid to an inside of the cylinder device to thereby cause the cylinder device to expand and contract, wherein the pump device comprises:

a first case having a channel in which hydraulic fluid flows;

a second case provided in contact with the first case; and a sacrificial anode coupled to one of the first case and the second case and suppressing corrosion of the first case and the second case, at least one of the first case and the second case comprises an insulating section that interrupts electric coupling between the first case and the second case, and the pump device further comprising a valve member provided in the channel, controlling the flow of the hydraulic fluid flowing in the channel, and electrically coupling the first case and the second case.

* * * * *